US006207916B1

(12) United States Patent
Pniok et al.

(10) Patent No.: US 6,207,916 B1
(45) Date of Patent: Mar. 27, 2001

(54) ELECTRIC ARC EXPLOSION CHAMBER SYSTEM

(75) Inventors: Thomas Pniok, Hamburg; Claus-Peter Schulze, Neumunster, both of (DE)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/402,770

(22) PCT Filed: Apr. 9, 1998

(86) PCT No.: PCT/EP98/02099

§ 371 Date: Dec. 23, 1999

§ 102(e) Date: Dec. 23, 1999

(87) PCT Pub. No.: WO98/47161

PCT Pub. Date: Oct. 22, 1998

(30) Foreign Application Priority Data

Apr. 11, 1997 (DE) ..... 197 15 116

(51) Int. Cl.[7] ..... H01H 9/30; H01H 33/04

(52) U.S. Cl. ..... 218/1; 218/15; 218/149; 218/152; 218/156; 335/201; 361/600

(58) Field of Search ..... 218/149–152, 218/155–158, 1, 15, 117, 46, 47, 76, 90; 200/306, 304, 305; 335/6–10, 201

(56) References Cited

U.S. PATENT DOCUMENTS

| | | | | |
|---|---|---|---|---|
| 3,621,169 | * | 11/1971 | Heft et al. | 218/151 |
| 4,612,426 | * | 9/1986 | Maier et al. | 218/152 |
| 4,764,650 | * | 8/1988 | Bur et al. | 218/157 X |
| 4,845,460 | * | 7/1989 | Manthe et al. | 335/201 |
| 4,884,047 | * | 11/1989 | Baginski et al. | 335/10 |
| 4,935,589 | * | 6/1990 | Kohanawa | 218/152 |
| 4,945,327 | * | 7/1990 | Doughty et al. | 335/201 |
| 4,958,135 | * | 9/1990 | Baginski et al. | 335/8 |
| 5,811,749 | * | 9/1998 | Bausch et al. | 218/157 |
| 5,945,650 | * | 8/1999 | Holland et al. | 218/1 |

FOREIGN PATENT DOCUMENTS

| | | | |
|---|---|---|---|
| 3840940 A1 | * | 6/1989 | (DE) . |
| 225207 A1 | * | 6/1987 | (EP) . |
| 2042263 A1 | * | 9/1980 | (GB) . |

* cited by examiner

*Primary Examiner*—J. R. Scott
(74) *Attorney, Agent, or Firm*—Cantor Colburn LLP; Carl B. Horton

(57) ABSTRACT

An arcing chamber system having one or more chamber bodies connected in series, wherein one or more arcing chamber modules, are arranged in each chamber body is present. A plurality of arcing chamber modules may be employed to achieve for various contact ratings. This allows the arcing chamber system of the present invention to be adapted, in simple fashion, to a variety of working voltages and a variety of contact ratings.

17 Claims, 3 Drawing Sheets

ELECTRIC ARC EXPLOSION CHAMBER SYSTEM

FIELD OF THE INVENTION

The invention relates generally to arcing chambers, and, more particularly, to an arcing chamber arrangement for use in direct-current switching devices.

BACKGROUND OF THE INVENTION

In contrast to alternating-current networks, natural current zero passage does not take place with direct current. Arcing chambers in direct-current switching devices produce an arcing voltage which is greater than the working voltage, thus forcing the current to zero and dissipating the energy stored in the network. The arcing voltage lies significantly above the working voltage. For example, at a working voltage of 500 V, the appearance of an arcing voltage of 800 V can be expected. However, due to the existing insulation ability of the network, arcing voltage must be limited to a maximum value. Thus, different working voltages require different arcing chambers.

Arcing chambers differ greatly in structure have hitherto been used in direct-current rapid-action switching devices for different working voltages and different switching properties. This entails great structural complexity as well as correspondingly high manufacturing costs.

SUMMARY OF THE INVENTION

In an exemplary embodiment of the invention an arcing chamber system comprises elements of a chamber body and an arcing chamber module. Depending upon the desired working voltage, a corresponding number of arcing chamber modules is used in a chamber body. If the size of the chamber body is insufficient for the working voltage of the network to be considered, a plurality of chamber bodies may be connected in series, so that the required number of arcing chamber modules can always be used.

In addition, adaptation to a desired contact rating is accomplished by the selection of appropriate arcing chamber modules. The chamber bodies are designed so that they are capable of accommodating narrow as well as wider arcing chamber modules. For this purpose, a plurality of grooves spaced equally apart is provided in the chamber body on two facing inner sides, while, depending upon the desired contact rating, the arcing chamber modules have a width corresponding to N times two neighboring grooves, N being a whole positive number.

DESCRIPTION OF THE PREFERRED EMBODIMENT

Figure 1:
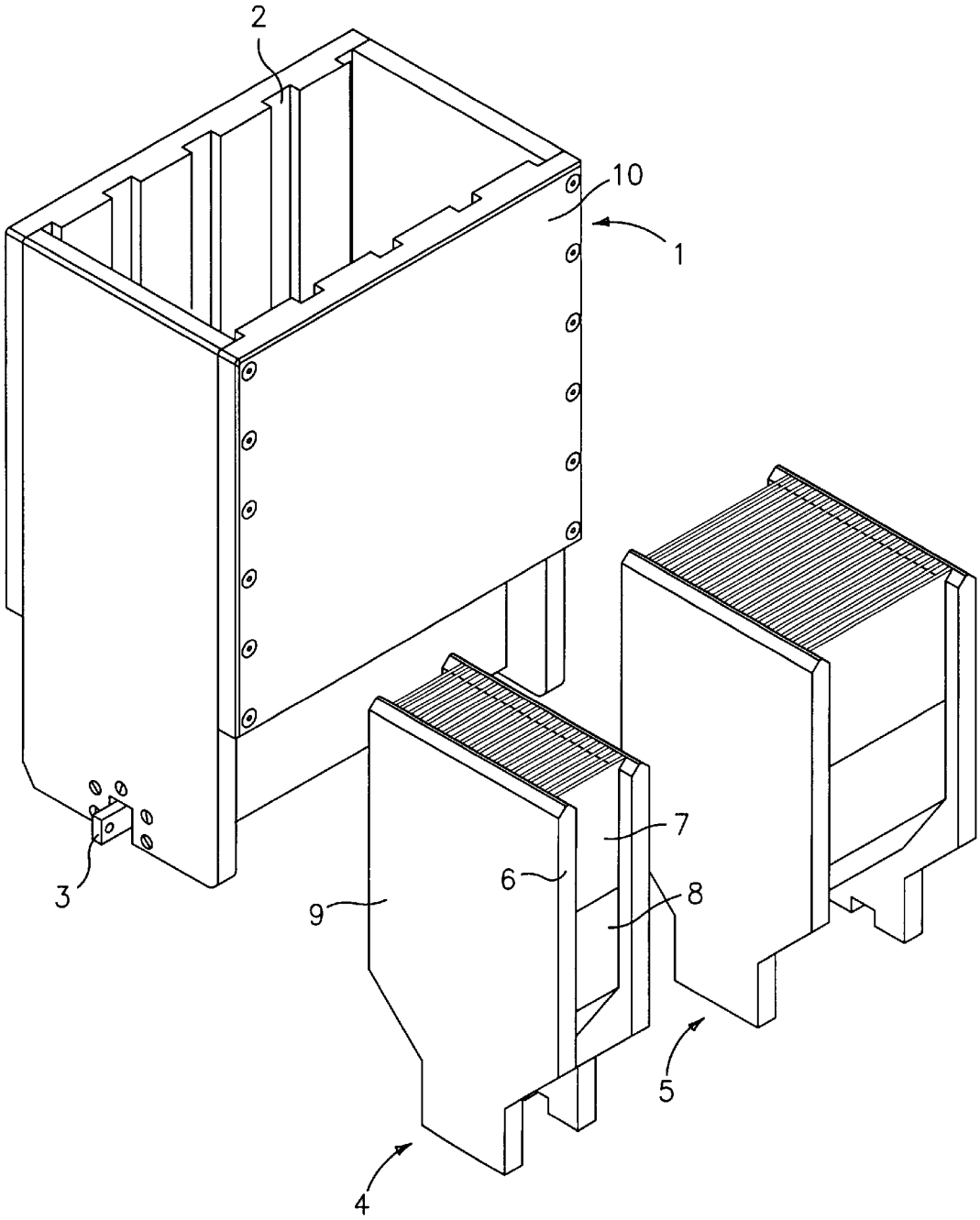
FIG. 1 shows a perspective representation of a chamber body as well as of two unlike arcing chamber modules.

Referring to FIG. 1, a chamber body is generally shown at 1. A groove 2 is arranged on an inner side of a wall of the chamber body. A plurality of grooves spaced equally apart is provided along two facing inner sides of the chamber body, the grooves in the edge region having half the groove width of the remaining grooves arranged on the inner sides.

In the lower part of the chamber body 1, arcing probes 3 provide a means for an arc to be brought up to the chamber body. The arcing probes 3 are arranged in the edge region of the outer surfaces of two facing wall parts, and the individual arcing chamber modules are joined together by arcing probes (not shown).

In addition, a small arcing chamber module 4 and a large arcing chamber module 5 are shown in FIG. 1. The two modules 4, 5 have two side parts 9, between which are provided a multiplicity of quenching plates 8 and insulating parts 7 arranged above them.

The chamber body 1, the side parts 9, the arcing chamber modules 4, 5 and the insulating parts 7 consist of electrically insulating thermally stable material which has a high heat capacity in order to be able to sufficiently absorb the energy of an arc and thereby quench the arc.

By way of an example, the chamber body 1 has a height of 40 cm, a width of 20 cm and a depth of 40 cm. In these size proportions, the two arcing chamber modules 4, 5 are provided for a working voltage of 500 V. The large module 5 is provided for double the rating of the small module 4. The current appearing in the arcing chamber system of the invention may lie in the region of 100 kA.

The quenching plates 8 and the insulating parts 7 are arranged between the side parts 9 so that the side parts 9, at the back and front ends, project with respect to the quenching plates 8 and the insulating parts 7. The resulting projecting elements 6 then form guide elements which can be slipped into the corresponding grooves 2 of the chamber body 1 in order to fix the modules 4, 5 in the chamber body 1.

In this example, the number of grooves in the chamber body 1 and the width of the arcing chamber modules 4, 5 are selected so that either four small modules 4, two large modules 5 or two small modules 4 and one large module 5 can be slipped into one arcing chamber. However, the invention is not limited to this example. The width of the chamber body 1 may be selected to be larger, so that a greater number of grooves 2 can be arranged in the chamber body, or the arcing chamber modules may be larger or smaller. Alternatively, a still larger arcing chamber module 5, which extends over not only three grooves, but over four or more grooves and hence is suitable for a greater contact rating, may be provided.

Figure 2:
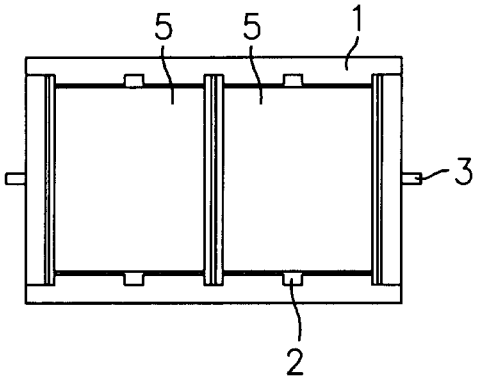
FIGS. 2 to 6 show various possibilities of combination for a variety of contact ratings and a variety of working voltages.
Figure 3:
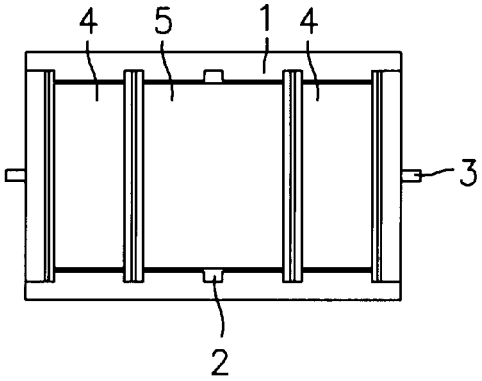
Figure 4:
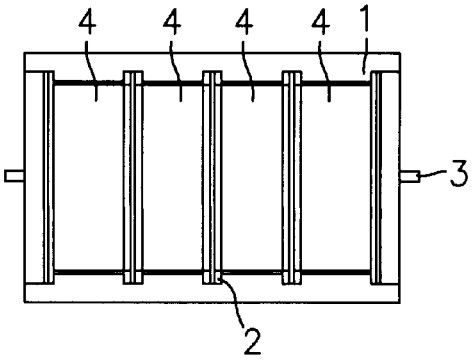

FIGS. 2, 3 and 4 show an arcing chamber system having a single chamber body 1. Here the chamber body 1 of FIG. 2 is equipped with two large modules 5, and the chamber body 1 shown in FIG. 4 is equipped with four small chamber modules 4. The chamber body 1 shown in FIG. 3 is equipped with two small modules 4 and one large module 5.

Figure 5:
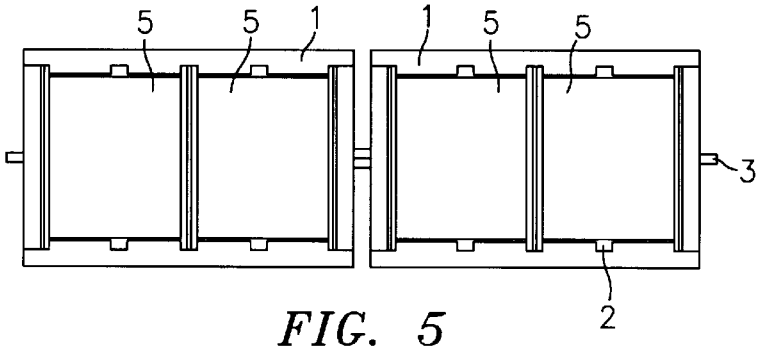
Figure 6:
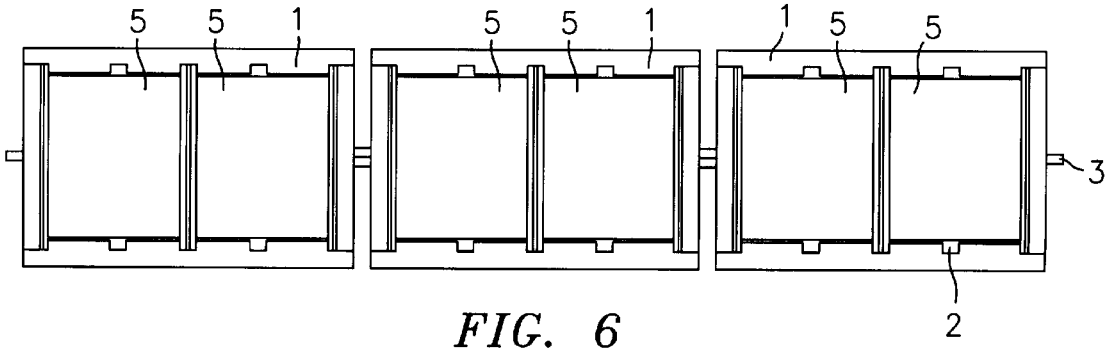

The arcing chamber systems shown in FIGS. 5 and 6 have two and three chamber bodies 1 respectively, which are connected in series in each instance.

Each of the chamber bodies shown in FIGS. 5 and 6 is provided there with two large modules.

As stated above, in the case of the dimensions indicated, a single module is provided for a working voltage of 500 V and an arcing voltage of 800 V. Thus the system shown in FIG. 2 is suitable for a working voltage of 1000 V, the system shown in FIG. 3 for a working voltage of 1500 V, the systems shown in FIGS. 4 and 5 for a working voltage of 2000 V, and the system shown in FIG. 6 for a working voltage of 3000 V.

The arcing chamber system shown in FIG. 4 has exclusively small modules and is therefore suitable only for a small contact rating. On the other hand, the systems shown in FIGS. 2, 5 and 6 have exclusively large modules and are thus suitable for a higher rating.

The system shown in FIG. 3 has small as well as large arcing chamber modules 4, 5, and thus is suitable for a contact rating higher than a low contact rating.

However, the invention is not limited to the examples shown. But common to all the arcing chamber systems shown is the provision of a universal chamber body, which may be provided with unlike sets of components, while the series connection of a plurality of arcing chambers allows the arcing chamber system to be adapted to the working voltage and the required contact rating. Each arcing chamber, regardless of the sizing of the chamber body and the widths of the quenching plates, can be equipped with an unlike number of modules. The addition of a plurality of arcing chambers makes it possible to increase the working voltage appropriately.

Since switching properties are determined, among other things, by the capacity for absorption of energy by the entire arcing chamber system and hence the heat capacity of the entire mass of the system, the arcing chamber system may alternatively be modified with respect to its contact rating. A working voltage, for example, of 2000 V then can be obtained in the example of FIG. 4 as well as in the example of FIG. 5 while, however, in the example of FIG. 4, the contact rating is lower than in the example of FIG. 5. Hence, the arcing chamber system shown can be adapted to a multiplicity of different working voltages and a multiplicity of different contact ratings.

In addition, the arcing chamber system shown is in no way limited to use in a direct-current switching device but may alternatively find use in an alternating-current switching device in a comparable form. While preferred embodiments have been shown and described, various modifications and substitutions may be made thereto. Accordingly, it is to be understood that the present invention has been described by way of illustrations and not limitation.

What is claimed is:

1. An arcing chamber system, comprising:

a plurality of chamber bodies connected in series;

an arcing chamber module arranged in each of said chamber bodies;

grooves for securing said arcing chamber module in each of said chamber bodies; and a plurality of quenching plates disposed within said arcing chamber module, arranged parallel to one another between side parts.

2. The arcing chamber system of claim 1, wherein said grooves comprise parallel grooves, spaced equally apart, said grooves being arranged on inner sides of facing walls of each of said chamber bodies.

3. The arcing chamber system of claim 2, wherein said grooves in edge regions of said walls have a width half as great as a width of said grooves spaced further away from the edge regions of walls.

4. The arcing chamber system of claim 1, further comprising an arcing probe in an edge region of facing sides of each of said chamber bodies.

5. The arcing chamber system of claim 1, wherein said arcing chamber module comprises a plurality of insulating parts arranged between said side parts and adjacent to said quenching plates.

6. The arcing chamber system of claim 5, wherein said side parts are sized so as to project beyond said quenching plates and said side parts having a thickness corresponding to the width of said grooves in the edge regions or half the width of said grooves spaced further away from the edge regions.

7. The arcing chamber system of claim 1, wherein said arcing chamber module comprises guide elements for securing said arcing module in each of said chamber bodies.

8. The arcing chamber system of claim 7, wherein said guide elements are arranged on said facing sides.

9. The arcing chamber system of claim 1, wherein said side parts of said arcing chamber module and said walls of each of said chamber bodies comprises an electrically insulating thermally stable material having a high heat capacity.

10. The arcing chamber system of claim 1, wherein a distance between said side parts is N times a distance between two neighboring said grooves, wherein N is a whole positive number.

11. The arcing chamber system of claim 10, wherein the distance between said side parts and thereby said quenching plates and said parts have a width selected in response to a desired contact rating.

12. The arcing chamber system of claim 1, wherein said arcing chamber module comprises a number of arcing chamber modules selected in response to an expected working voltage.

13. The arcing chamber system of claim 1, wherein said arcing chamber module is disposed within each of said chamber bodies such that said side parts engage in said grooves of said walls of each of said chamber bodies.

14. An arcing chamber, comprising:

a first chamber body;

a first arcing chamber module removably secured within said first chamber body, said first arcing chamber module including:

a first pair of side parts arranged parallel to each other, said first pair of side parts extending between opposing sides of said first chamber body, and a first plurality of quenching plates arranged parallel to one another between said first pair of side parts; and a second arcing chamber module removably secured within said first chamber body, said second arcing chamber module including:

a second pair of side parts arranged parallel to each other and extending between said opposing sides of said first chamber body, one of said second pair of side parts proximate to one of said first pair of side parts; and a second plurality of quenching plates arranged parallel to one another between said second pair of side parts.

15. The arcing chamber system of claim 14, further comprising a second chamber body removably secured to said first chamber body.

16. The arcing chamber system of claim 14, wherein said opposing sides of said first chamber body include grooves, said first and second pair of side parts being arranged within said grooves.

17. The arcing system of claim 14, wherein each of said first plurality of quenching plates is longer that each of said second plurality of quenching plates.

* * * * *